US010792800B2

(12) United States Patent
Parks

(10) Patent No.: US 10,792,800 B2
(45) Date of Patent: Oct. 6, 2020

(54) APPLICATION-SPECIFIC MULTI-TOOL

(71) Applicant: CruzTools, Inc., Sonora, CA (US)

(72) Inventor: Dan Parks, Sonora, CA (US)

(73) Assignee: GrooveTech Tools, Inc., Sonora, CA (US)

( * ) Notice: Subject to any disclaimer, the term of this patent is extended or adjusted under 35 U.S.C. 154(b) by 92 days.

(21) Appl. No.: 15/816,185

(22) Filed: Nov. 17, 2017

(65) Prior Publication Data

US 2019/0152040 A1 May 23, 2019

(51) Int. Cl.
*B25F 1/04* (2006.01)

(52) U.S. Cl.
CPC ..... *B25F 1/04* (2013.01)

(58) Field of Classification Search
CPC ..... B25F 1/04
USPC ..... 81/440
See application file for complete search history.

(56) References Cited

U.S. PATENT DOCUMENTS 2,804,970 A * 9/1957 Kuc ..... B25B 13/56 206/375
5,450,774 A 9/1995 Chang
6,085,620 A * 7/2000 Anderson ..... B25F 1/003 7/118
6,128,981 A * 10/2000 Bondhus ..... B25B 13/56 7/168
6,286,168 B1 * 9/2001 Woodruff ..... B25B 13/56 7/138
6,751,819 B2 * 6/2004 Chuang ..... B25B 13/56 157/1.3
8,490,523 B2 7/2013 Tsai et al.
10,071,469 B2 * 9/2018 Gallegos ..... B25G 1/085
2010/0122419 A1 5/2010 Zupancio-Albin
2011/0145997 A1 6/2011 Wu
2014/0102267 A1 4/2014 Hermansen et al.
2015/0336257 A1 11/2015 Ragner

FOREIGN PATENT DOCUMENTS

TW I600512 B 10/2017

* cited by examiner

*Primary Examiner* — Hadi Shakeri
(74) *Attorney, Agent, or Firm* — Ice Miller LLP

(57) ABSTRACT

An application-specific multi-tool is provided. The multi-tool includes a first side portion, a second side portion, and a central portion extending between and connecting the first side portion and the second side portion. The central portion has a first central portion side and a second central portion side opposite the first central portion side. An axle extends between the first side portion and the second side portion. A plurality of tools is rotatably coupled to the axle.

11 Claims, 12 Drawing Sheets

APPLICATION-SPECIFIC MULTI-TOOL

TECHNICAL FIELD OF THE DISCLOSED EMBODIMENTS

The presently disclosed embodiments generally relate to multi-tools and, more specifically, to application-specific multi-tools.

BACKGROUND OF THE DISCLOSED EMBODIMENTS

Certain objects, vehicles, or equipment include various fasteners and/or other parts that require checking, set-up, adjustment, and/or maintenance frequently or on occasion in order to ensure proper and optimal operation. For example, a guitar or bass musical instrument may be adjusted in various ways to optimize playability, including, without limitation, a truss rod, a string height or action, a string length or intonation, a pickup height, and a tremolo system. In this non-limiting example, multiple tools in a unique combination that may include both inch and metric sizes are needed in order to properly adjust the instrument. Conversely, generic multi-tools are designed for general use and include a single category of tools for use across many applications and tasks, such as, for example, a metric hex wrench set having every size increment from 1.5 millimeters to 8 millimeters. As a result, the multi-tool is excessively bulky and heavy to adversely affect its portability and ease of use. Further, because generic multi-tools are designed for broad use and include tools not needed for a specific application, such unneeded tools increase the overall size of the multi-tool and inhibit the use of needed tools by reducing the available space and ability to easily extend, retract, and/or generally use the needed tool. Finally, many objects, vehicles, and/or equipment, including the guitar or bass instrument discussed in the non-limiting example above, still require a combination of many different types of tools to adjust, set-up, and/or otherwise be used with the application, which reduces access to, portability of, and/or ease of use of the necessary tools for those specific applications.

Particular application-specific tools, such as outdoorsman or bicycle multi-tools in specific examples, may provide tools generally intended for use with a particular category of devices or applications. However, known application-specific tools are only category-specific and not specific to a particular object, vehicle, or other piece of equipment and, as such, include unnecessary tools to cause one or more of the problems stated above.

Therefore, there exists a need in the art for an application-specific multi-tool that provides tools configured to adjust and/or otherwise operate with a particular vehicle, instrument, object, or other application. There further exists a need in the art for an application-specific multi-tool that combines only the tools for a specific vehicle, instrument, object, or other application into a single assembly.

SUMMARY OF THE DISCLOSED EMBODIMENTS

In accordance with an embodiment of the present disclosure, a multi-tool is provided. The multi-tool includes a first side portion, a second side portion, a central portion extending between and connecting the first side portion and the second side portion, the central portion having a first central portion side and a second central portion side opposite the first central portion side, a first axle extending between the first side portion and the second side portion at a first end portion, a second axle extending between the first side portion and the second side portion at a second end portion, a first plurality of tools rotatably coupled to the first axle, a second plurality of tools rotatably coupled to the second axle, a first central portion side first tool surface, and a first central portion side second tool surface spaced from the first central portion side first tool surface and parallel to the first central portion side first tool surface.

In accordance with an embodiment of the present disclosure, a multi-tool is provided. The multi-tool includes a first side portion, a second side portion, a central portion extending between and connecting the first side portion and the second side portion, the central portion having a first central portion side and a second central portion side opposite the first central portion side, an axle extending between the first side portion and the second side portion, a plurality of tools rotatably coupled to the axle and corresponding to a plurality of fasteners of an object such that the plurality of tools is configured to operate only with the plurality of fasteners.

In accordance with an embodiment of the present disclosure, a multi-tool is provided. The multi-tool includes an integrally formed body having a first side portion defining a first side of the body, a second side portion defining a second side of the body, a central portion disposed between the first side portion and the second side portion, a first side recess at a first central portion side, a second side recess at a second central portion side opposite the first central portion side, a first end cutout at a first end portion, and a second end cutout at a second end portion, a first axle extending from the first side portion to the second side portion through the first end cutout at the first end portion, a first axle fastener configured to apply a first axle compression force between the first side portion and the second side portion while the central portion maintains a separation of the first side portion and the second side portion, a second axle extending from the first side portion to the second side portion through the second end cutout at a second end portion, a second axle fastener configured to apply a second axle fastener compression force between the first side portion and the second side portion while the central portion maintains the separation of the first side portion and the second side portion, a first plurality of tools rotatably coupled to the first axle, disposed at least partially in the first end cutout at the first end portion, and corresponding to a first plurality of fasteners of an object such that the first plurality of tools is configured to operate only with the first plurality of fasteners, a second plurality of tools rotatably coupled to the second axle, disposed at least partially in the second end cutout at the second end portion, and corresponding to a second plurality of fasteners of the object such that the second plurality of tools is configured to operate only with the second plurality of fasteners, a first central portion side first tool surface accommodating at least one of the first plurality of tools in a retracted configuration, a first central portion side second tool surface spaced from the first central portion side first tool surface, disposed parallel to the first central portion side first tool surface, and accommodating at least one of the first plurality of tools in a retracted configuration such that the first plurality of tools in the retracted configuration is in a substantially parallel alignment, a second central portion side first tool surface accommodating at least one of the second plurality of tools in a retracted configuration, and a second central portion side second tool surface spaced from the second central portion side first tool surface, disposed parallel to the second central portion side first tool surface, and accommodating at least one of the second plurality of tools in a retracted configuration such that the second plurality of tools in the retracted configuration is in a substantially parallel alignment.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE ENCLOSED EMBODIMENTS

Figure 1:
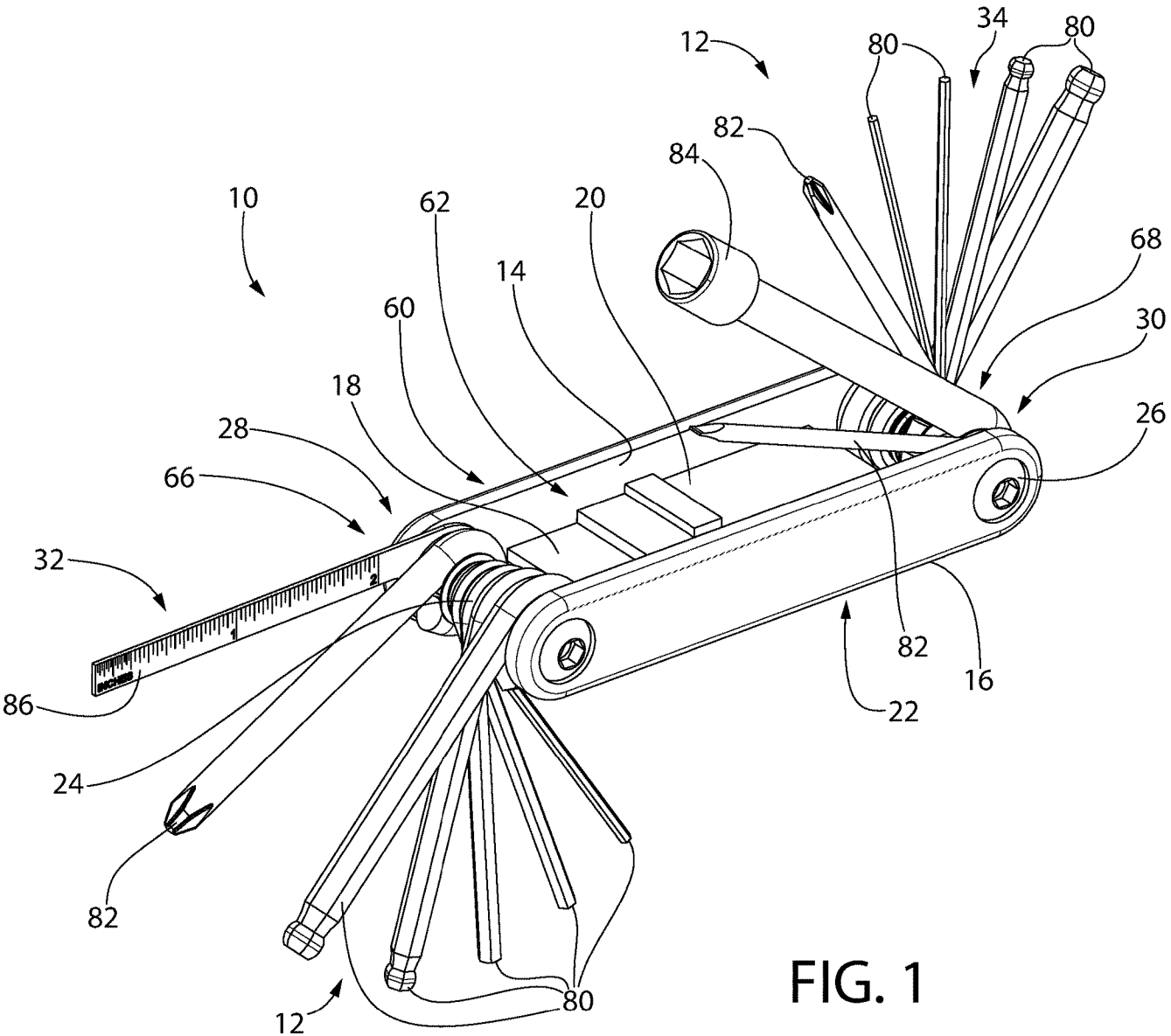
FIG. 1 is a perspective view of an application-specific multi-tool according to one embodiment of the present disclosure.
Figure 2:
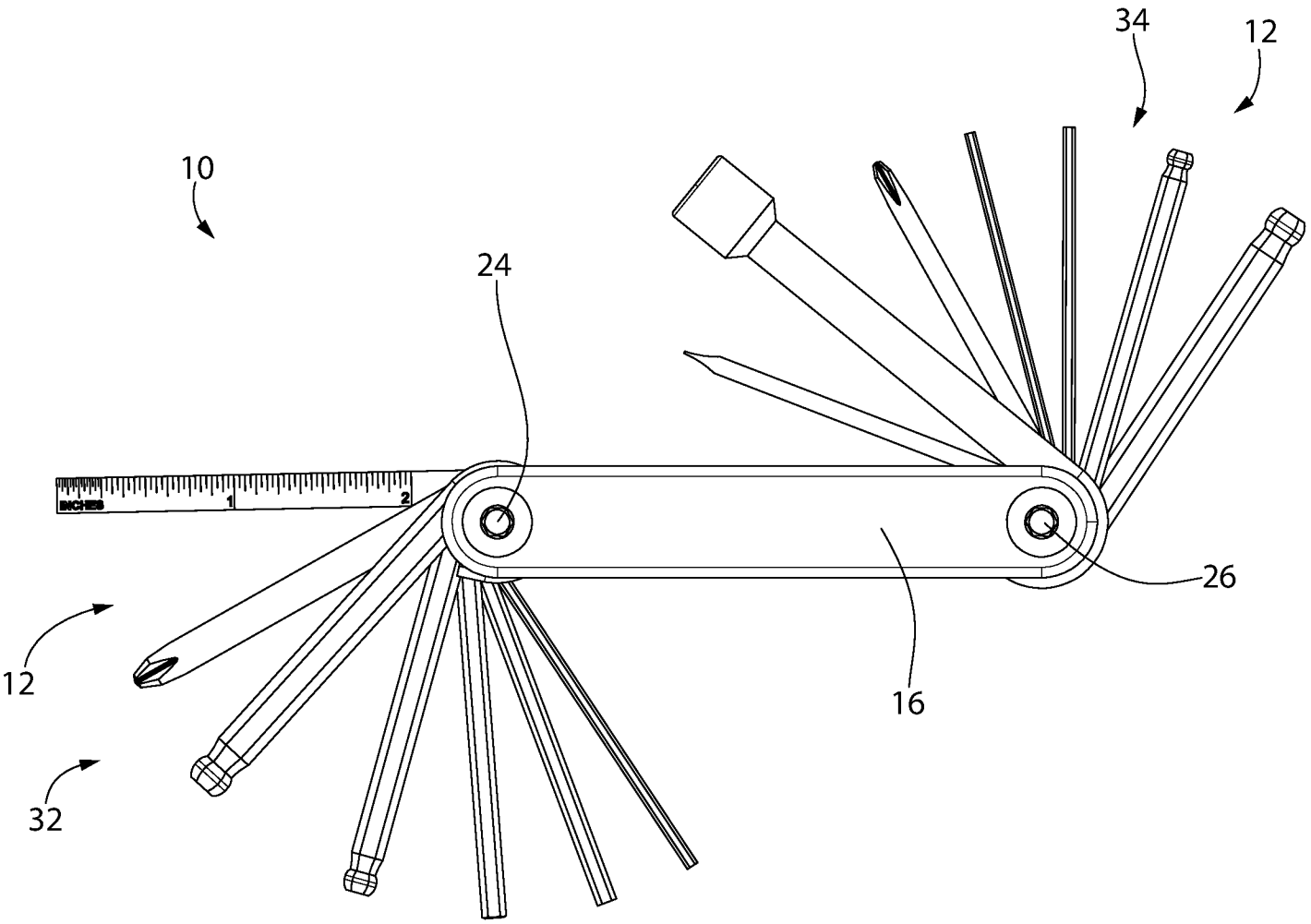
FIG. 2 is an elevation view of an application-specific multi-tool according to one embodiment of the present disclosure.
Figure 3:
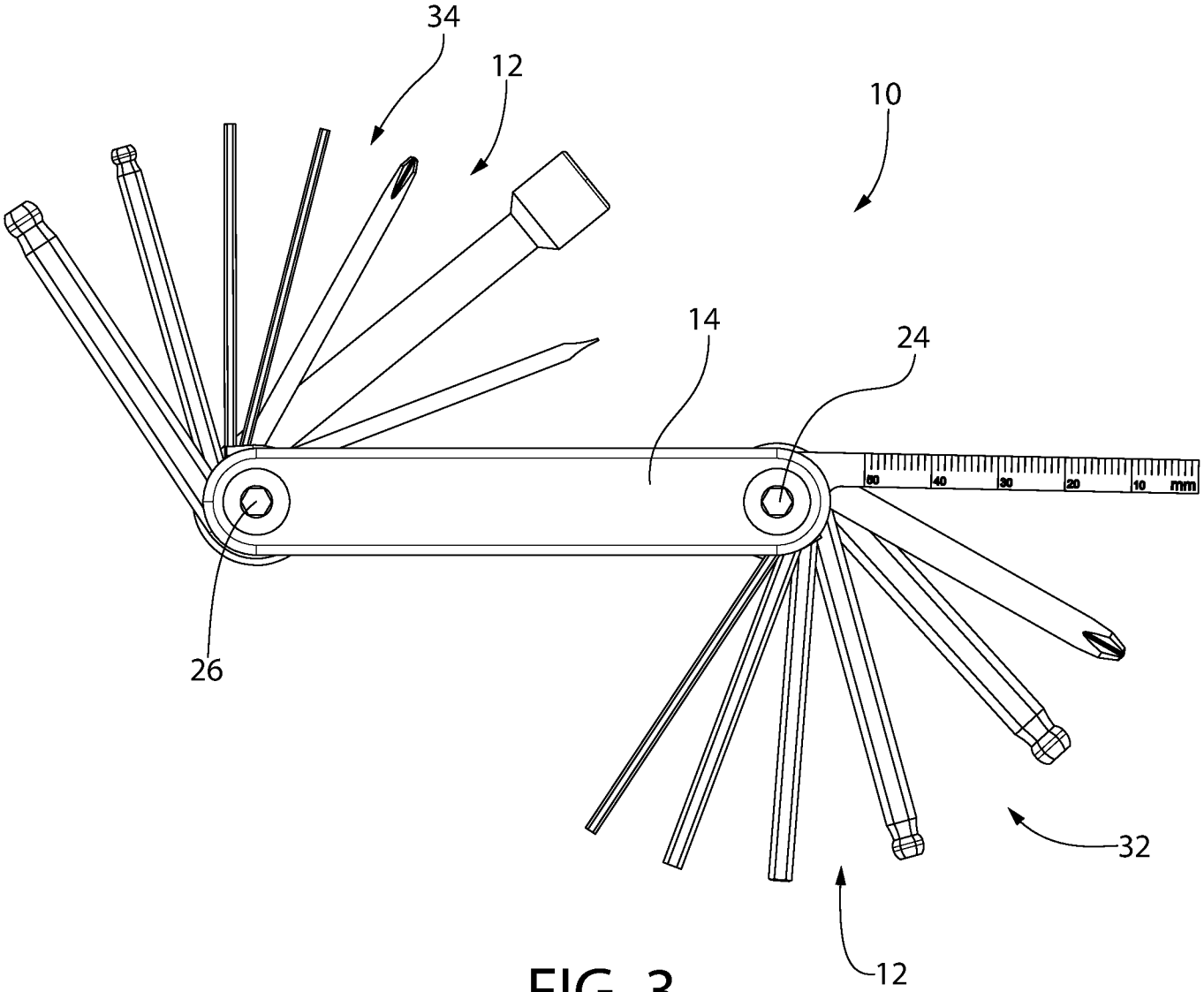
FIG. 3 is an elevation view of an application-specific multi-tool according to one embodiment of the present disclosure.
Figure 4:
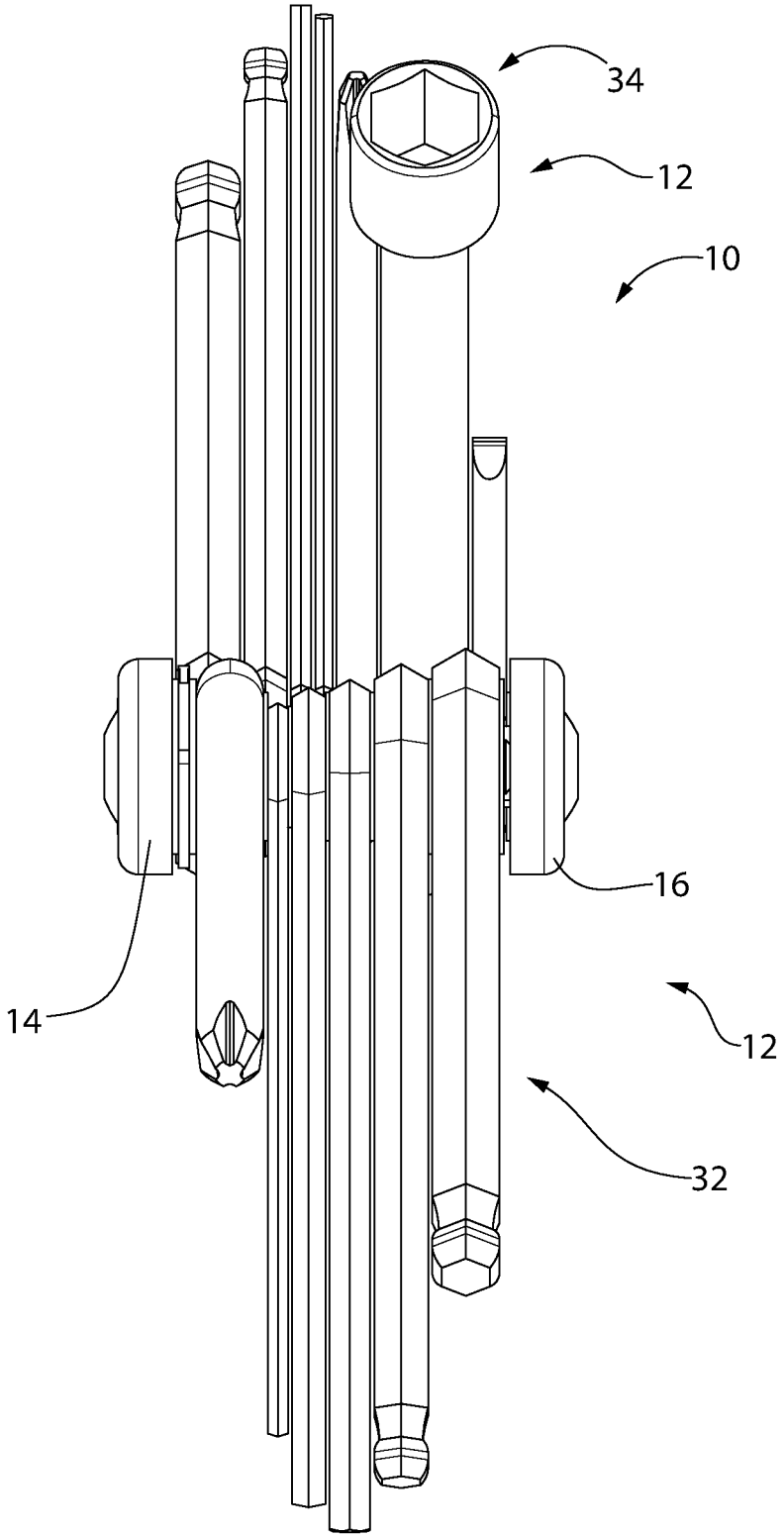
FIG. 4 is an elevation view of an application-specific multi-tool according to one embodiment of the present disclosure.
Figure 5:
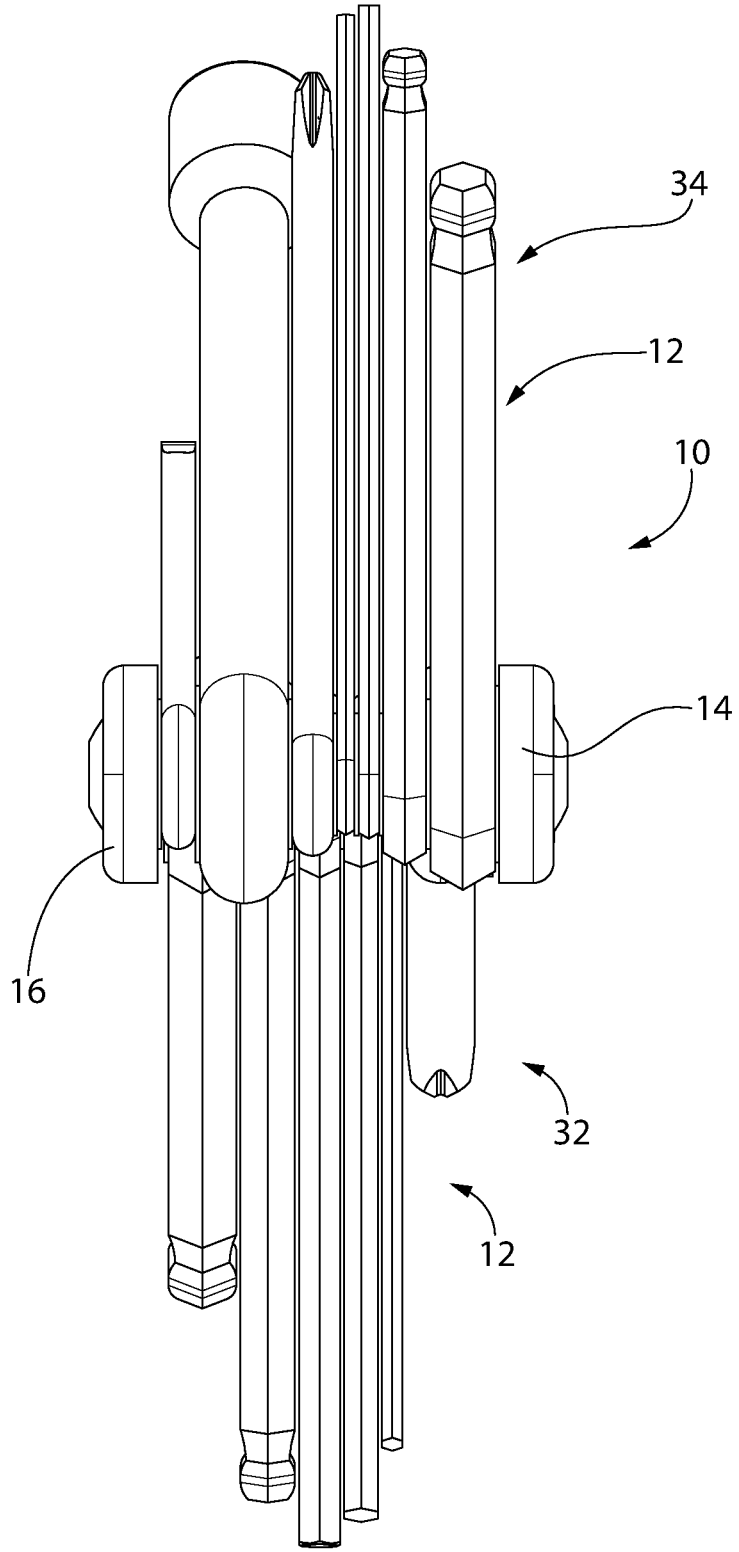
FIG. 5 is an elevation view of an application-specific multi-tool according to one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Reference is now made to the Figures, which illustrates a multi-tool 10 in accordance with an embodiment of the present disclosure. FIGS. 1-11 illustrate the multi-tool 10 having a plurality of tools 12 corresponding to and/or configured to operate with a plurality of fasteners (not shown) of a guitar or bass. In additional embodiments of the present disclosure, the multi-tool 10 includes the plurality of tools 12 corresponding to and/or configured to operate with a plurality of fasteners (not shown) or other adjustment points of another musical instrument, vehicle, and/or other object, to name non-limiting examples. The plurality of tools 12 is configured to operate only with the plurality of fasteners of an instrument, vehicle, and/or other object in particular embodiments. The instrument, vehicle, and/or other object of particular embodiments include a drum in a particular embodiment, a motorcycle in another embodiment, and a bicycle in another embodiment.

The multi-tool 10 includes an integrally formed body 60 in an embodiment. The multi-tool 10 or the body 60 of an embodiment includes a first side portion 14, a second side portion 16, and a central portion 18 extending between and connecting the first side portion 14 and the second side portion 16. In an embodiment not illustrated, the body 60, including one or more of the first side portion 14, the second side portion 16, and the central portion 18, is formed from a plurality of elements or members. The multi-tool 10 or the body 60 of the illustrated embodiment is made from fiber-reinforced nylon to provide an optimal combination of strength, weight, manufacturability, and aesthetic appearance. The multi-tool 10 or the body 60 is made from any other metallic, polymeric, elastomeric, composite, fiber-reinforced, or non-fiber-reinforced material in additional embodiments.

The central portion 18 has a first central portion side 20 and a second central portion side 22 opposite the first central portion side 20. The body 60 of an embodiment includes a first side recess 62 at the first central portion side 20, a second side recess 64 at the second central portion side 22 opposite the first central portion side 20. The body 60 further includes a first end cutout 66 at a first end portion 28 and a second end cutout 68 at a second end portion 30.

Figure 6:
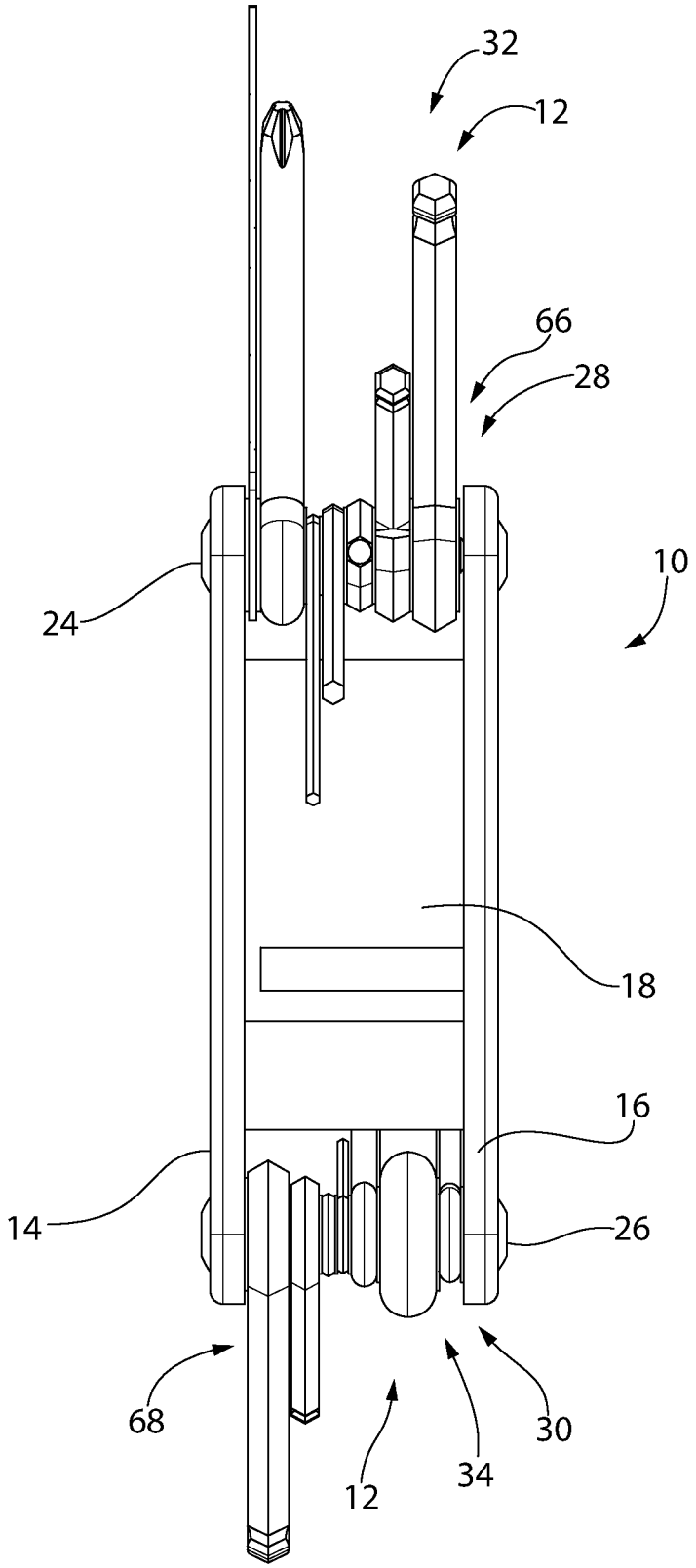
FIG. 6 is a plan view of an application-specific multi-tool according to one embodiment of the present disclosure.
Figure 7:
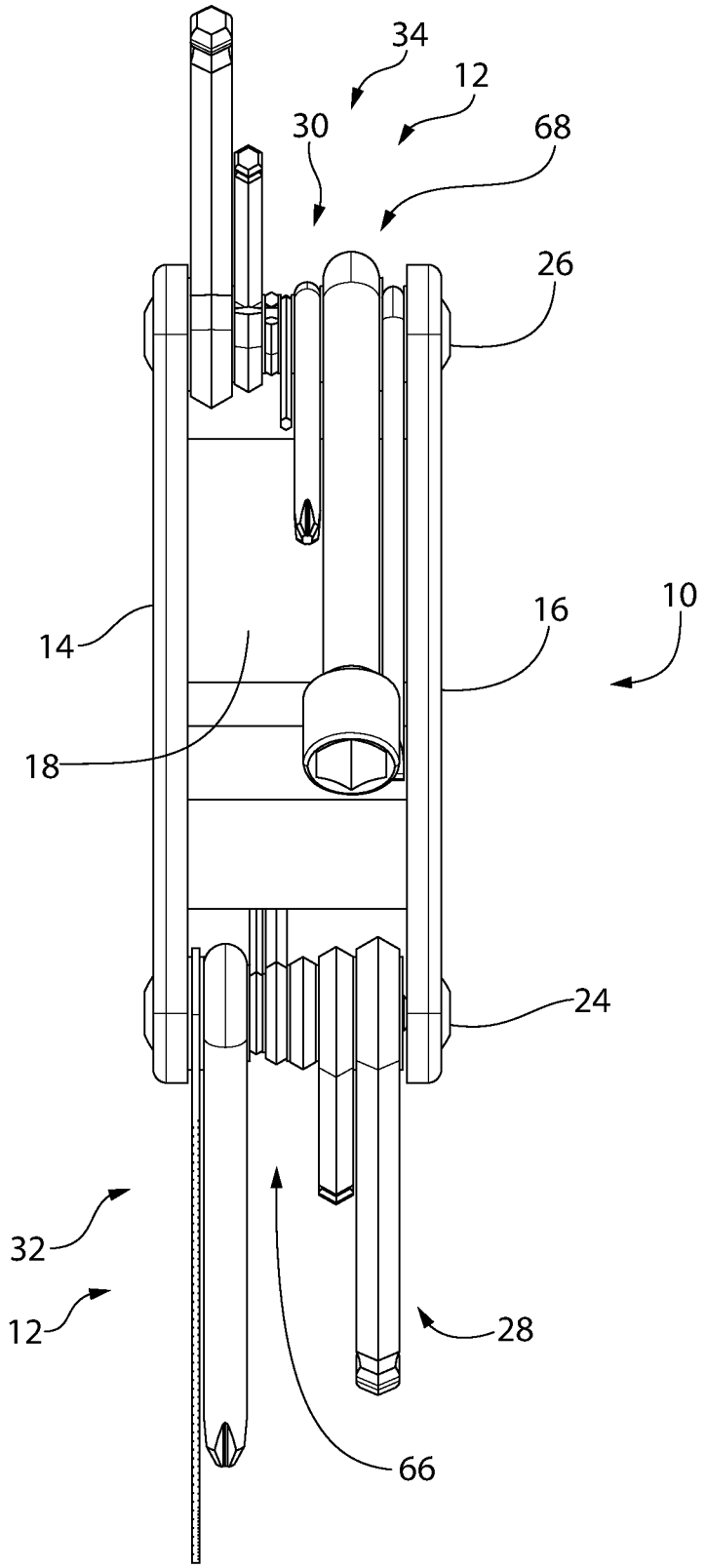
FIG. 7 is a plan view of an application-specific multi-tool according to one embodiment of the present disclosure.
Figure 8:
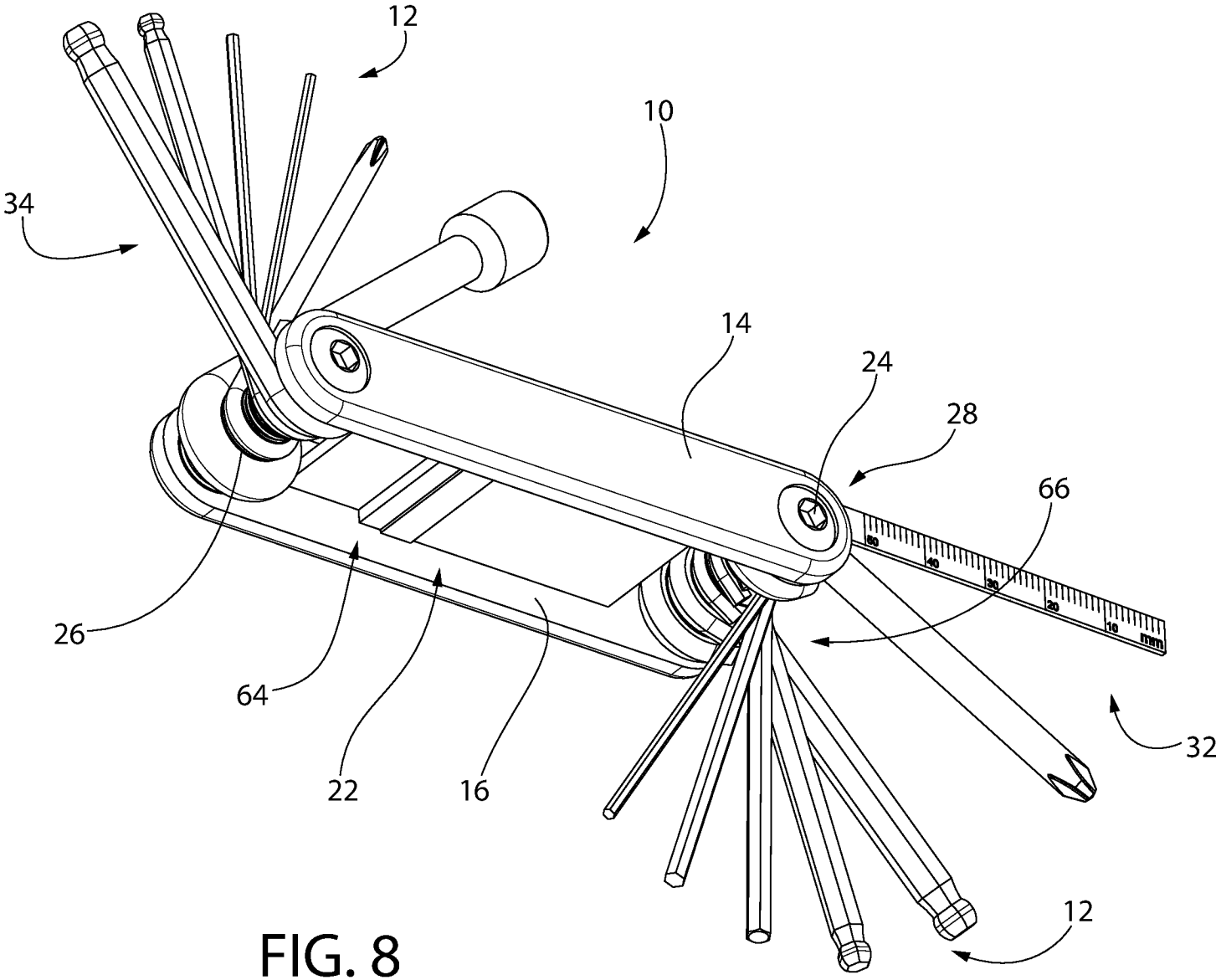
FIG. 8 is a perspective view of an application-specific multi-tool according to one embodiment of the present disclosure.

A first axle 24 and a second axle 26 extend between the first side portion 14 and the second side portion 16. The first axle 24 is disposed at the first end portion 28, and the second axle 26 is disposed at the second end portion 30, as illustrated in FIGS. 6 and 7. In an embodiment not shown, only one of the first axle 24 and the second axle 26 is included in the multi-tool 10. The plurality of tools 12 are rotatably coupled to the axle(s) 24, 26. In the illustrated embodiment, a first plurality of tools 32 rotatably coupled to the first axle 24, and a second plurality of tools 34 rotatably coupled to the second axle 26. The first plurality of tools 32 is rotatably coupled to the first axle 24 and disposed at least partially in the first end cutout 66 at the first end portion 28. The second plurality of tools 34 is rotatably coupled to the second axle 26 and disposed at least partially in the second end cutout 68 at the second end portion 30. In an embodiment, the first and/or second axle 24, 26 includes an outer surface, an outermost surface, or outermost cylindrical surface that is unthreaded.

Figure 11:
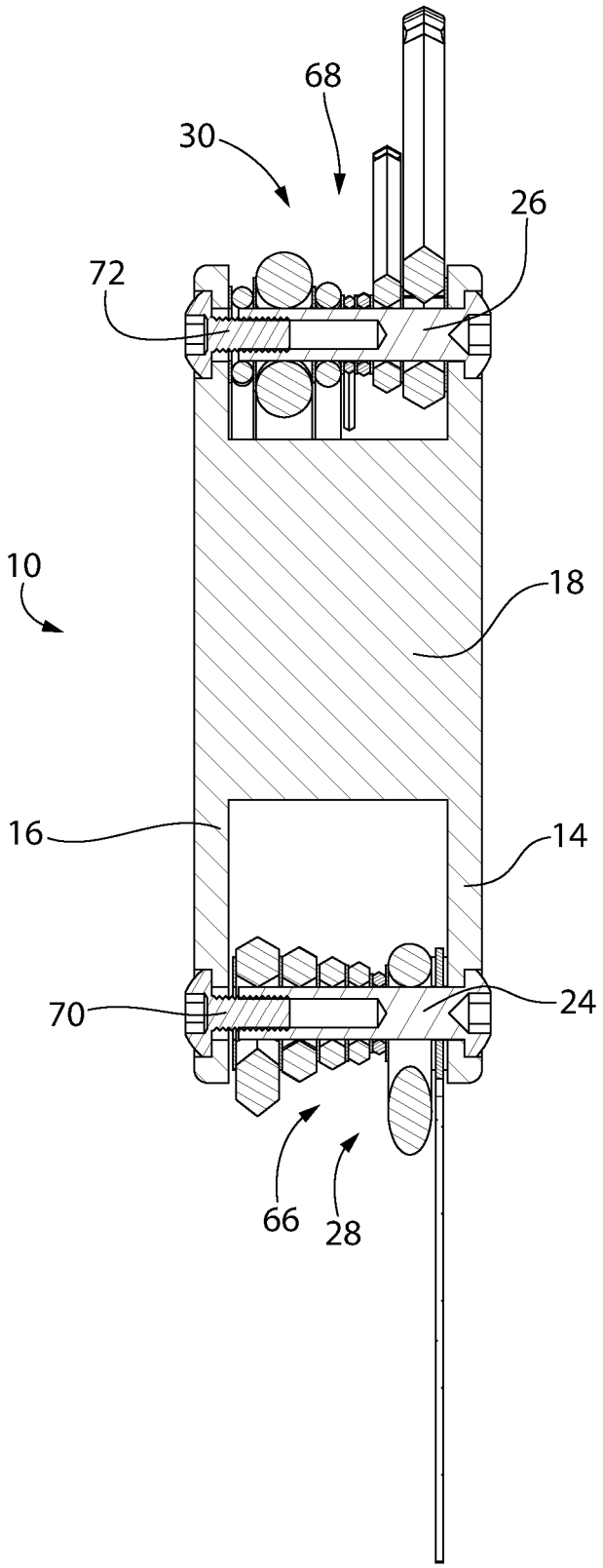
FIG. 11 is a cross-sectional view of an application-specific multi-tool according to one embodiment of the present disclosure.

Referring to FIG. 11, the first axle 24 extends from the first side portion 14 to the second side portion 16 through the first end cutout 66 at the first end portion 14. A first axle fastener 70 is configured to apply a first axle compression force between the first side portion 14 and the second side portion 16 while the central portion 18 maintains a separation of the first side portion 14 and the second side portion 16. The second axle 26 extends from the first side portion 14 to the second side portion 16 through the second end cutout 68 at the second end portion 30. A second axle fastener 72 is configured to apply a second axle fastener compression force between the first side portion 14 and the second side portion 16 while the central portion 18 maintains the separation of the first side portion 14 and the second side portion 16.

Figure 9:
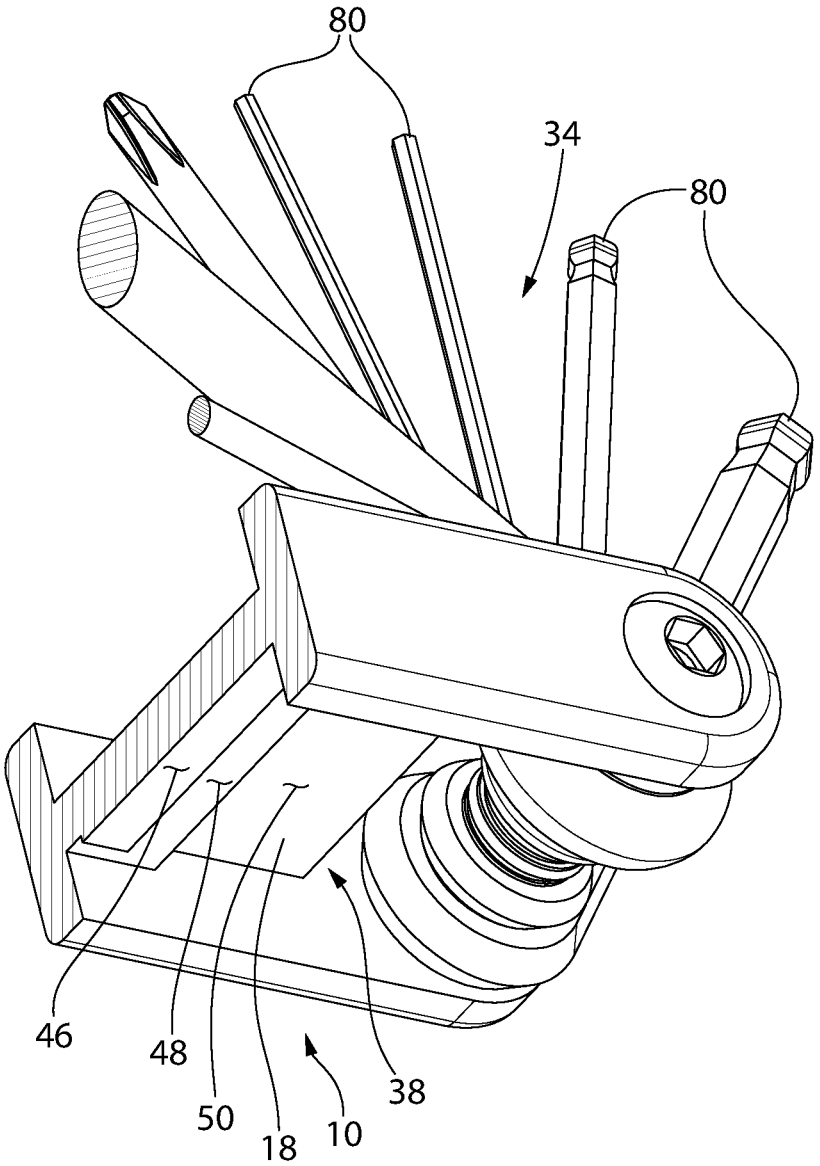
FIG. 9 is a cross-sectional perspective view of an application-specific multi-tool according to one embodiment of the present disclosure.
Figure 10:
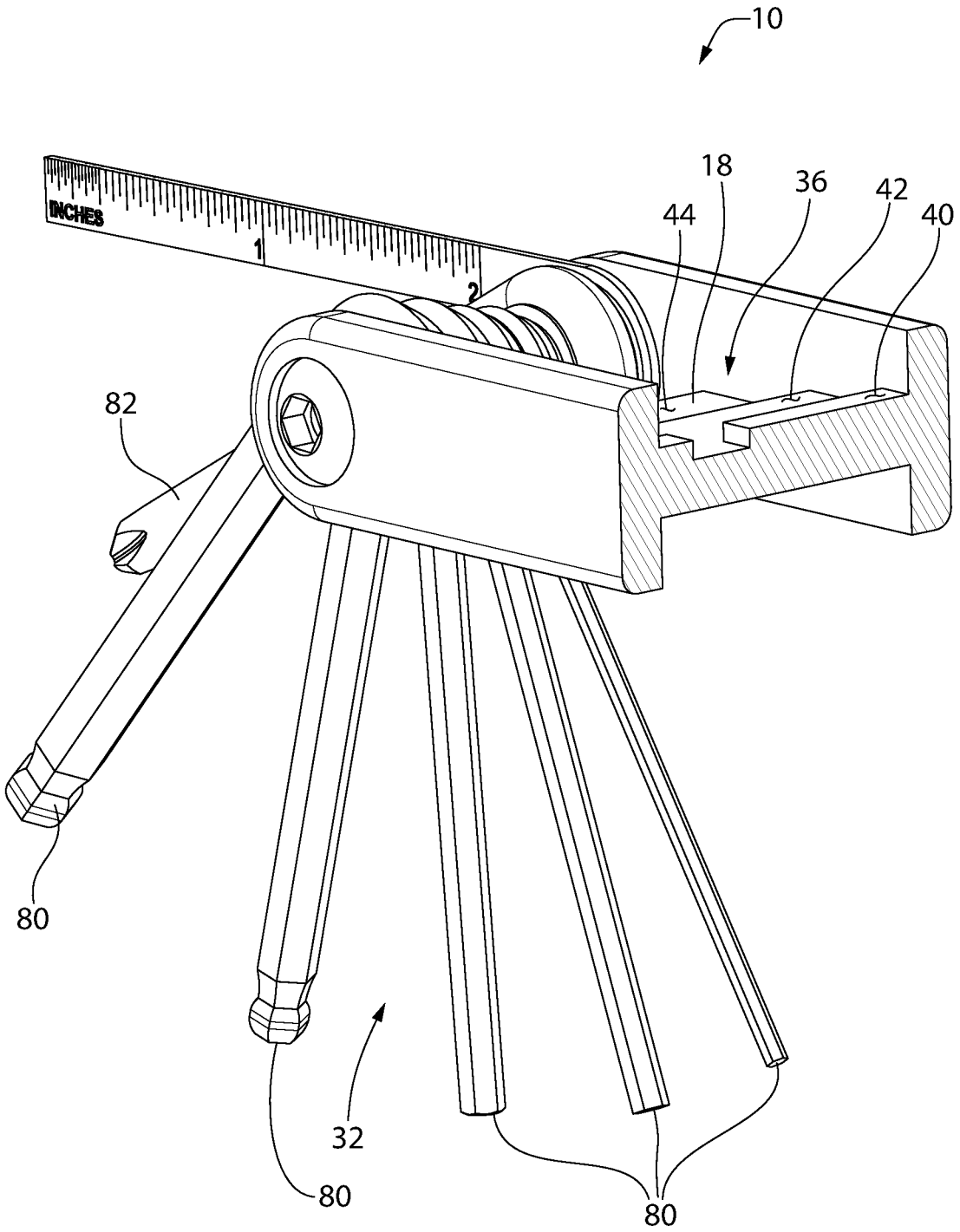
FIG. 10 is a cross-sectional perspective view of an application-specific multi-tool according to one embodiment of the present disclosure.

Referring now to FIGS. 9 and 10 with continuing reference FIGS. 1-8, the central portion 18 of the multi-tool 10 includes a first central portion side 36 and a second central portion side 38 opposite the first central portion side 36. The central portion 18 of the illustrated embodiment further includes a first central portion side first tool surface 40 and a first central portion side second tool surface 42 spaced from the first central portion side first tool surface 40 and parallel to the first central portion side first tool surface 40. The central portion 18 further includes, in at least one embodiment, a first central portion side third tool surface 44 spaced from the first central portion side first tool surface 40 and the first central portion side second tool surface 42 and parallel to the first central portion side first tool surface 40 and the first central portion side second tool surface 42. The first central portion side first tool surface 40 accommodating one or more of the second plurality of tools 34 in a retracted configuration. In an embodiment, the second plurality of tools 34 in the retracted configuration is in a substantially parallel alignment. A substantially parallel alignment of one or more embodiments described herein includes being parallel within 10 degrees, being parallel within 5 degrees in an embodiment, and being parallel within 2 degrees in an embodiment.

The central portion 18 further includes a second central portion side first tool surface 46 in an embodiment. An embodiment further includes a second central portion side second tool surface 48 spaced from the second central portion side first tool surface 46 and parallel to the second central portion side first tool surface 46. In at least one embodiment, a second central portion side third tool surface 50 is provided that is spaced from the second central portion side first tool surface 46 and the second central portion side second tool surface 48 and parallel to the second central portion side first tool surface 46 and the second central portion side second tool surface 48. The second central portion side first tool surface 46 accommodates one or more of the first plurality of tools 32 in a retracted configuration.

Figure 12:
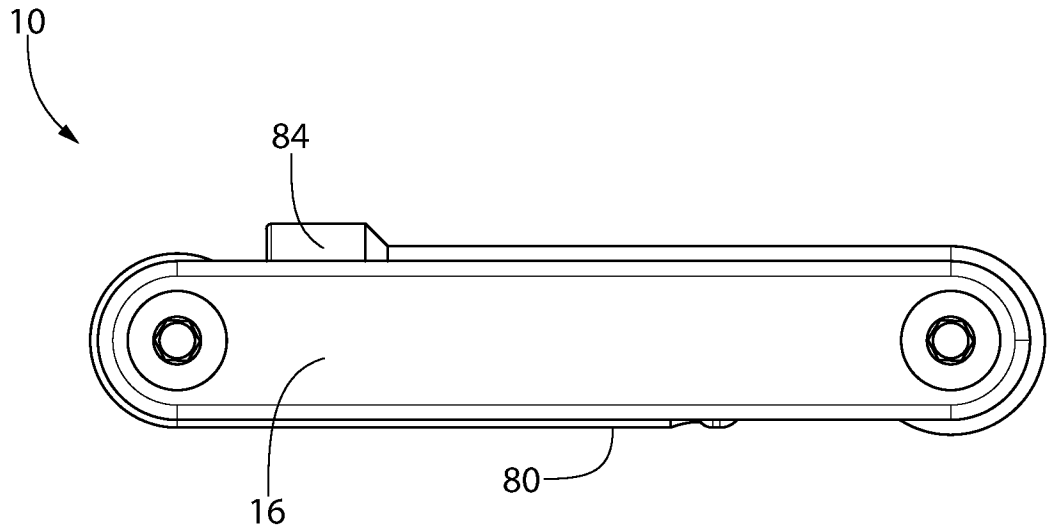
FIG. 12 is a side elevation view of an application-specific multi-tool according to one embodiment of the present disclosure.

FIG. 12 is a side elevation view of an embodiment of the multi-tool 10. Referring to FIG. 12, in an embodiment, the first plurality of tools 32 and/or the second plurality of tools 34 in the retracted configuration is/are in a substantially parallel alignment. As stated above, a substantially parallel alignment of one or more embodiments described herein includes two or more of the individual tools of the first plurality of tools 32 and/or the second plurality of tools 34 being parallel within 10 degrees, being parallel within 5 degrees in an embodiment, or being parallel within 2 degrees in an embodiment.

The first plurality of tools 32 and/or the second plurality of tools 34 includes one or more hex wrench(es) 80, screwdriver(s) 82, socket(s) 84, ruler(s) 86, and/or one or more additional tools. In particular embodiments, the first plurality of tools 32 and/or the second plurality of tools 34 includes both metric and standard versions of the same tool and/or both metric and standard versions of different tools.

It will be appreciated that the embodiments provided in the present disclosure provide a multi-tool that provides proper adjust of and/or operation with an instrument, a vehicle, and/or another object. The multi-tool of the present disclosure is lightweight, compact, easily stored and transported, and/or easily accessed for a specific application. As opposed to conventional tools or conventional multi-tools, the multi-tool 10 of the embodiments described herein provides a single tool to service, adjust, and/or otherwise operate with a particular object, vehicle, or other assembly. Further, by eliminating unnecessary tools in the multi-tool 10 of the present disclosure, the multi-tool 10 improves the ability to extend, retract, and/or otherwise access and/or use a tool of the multi-tool 10.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. A multi-tool comprising:

a first side portion;

a second side portion;

a central portion extending between and connecting the first side portion and the second side portion, the central portion having a first central portion side and a second central portion side opposite the first central portion side;

the first and second side portions extending from said central portion so as to define spaces therebetween on either side of said central portion;

a first axle extending between the first side portion and the second side portion at a first end portion;

a first axle fastener fastening the first side portion and the second side portion so as to apply a first axle fastener compression force between the first side portion and the second side portion while the central portion maintains a separation of the first side portion and the second portion;

a second axle extending between the first side portion and the second side portion at a second end portion;

a second axle fastener fastening the first side portion and the second side portion so as to apply a second axle fastener compression force between the first side portion and the second side portion while the central portion maintains the separation of the first side portion and the second side portion;

a first plurality of tools rotatably coupled to the first axle;

a second plurality of tools rotatably coupled to the second axle;

a first central portion side first tool surface; and a first central portion side second tool surface extending from the first central portion side first tool surface and spaced from the first central portion side first tool surface towards the second side portion and parallel to the first central portion side first tool surface;

a first central portion side third tool surface extending from the first central portion side second tool surface and spaced from the first central portion side first tool surface and the first central portion side second tool surface towards the second side portion and parallel to the first central portion side first tool surface and the first central portion side second tool surface.

2. The multi-tool of claim 1, further comprising a second central portion side first tool surface.

3. The multi-tool of claim 2, further comprising a second central portion side second tool surface spaced from the second central portion side first tool surface and parallel to the second central portion side first tool surface.

4. The multi-tool of claim 3, further comprising a second central portion side third tool surface spaced from the second central portion side first tool surface and the second central portion side second tool surface and parallel to the second central portion side first tool surface and the second central portion side second tool surface.

5. The multi-tool of claim 1, wherein at least one of the first plurality of tools and the second plurality of tools comprises at least one hex wrench.

6. The multi-tool of claim 5, wherein at least one of the first plurality of tools and the second plurality of tools comprises at least one screwdriver.

7. The multi-tool of claim 6, wherein at least one of the first plurality of tools and the second plurality of tools comprises at least one socket.

8. The multi-tool of claim 7, wherein at least one of the first plurality of tools and the second plurality of tools comprises at least one ruler.

9. The multi-tool of claim 8, wherein the at least one ruler comprises both metric and standard versions.

10. The multi-tool of claim 1, wherein the plurality of tools includes both a metric version and a standard version of a tool.

11. A multi-tool comprising:

an integrally formed body having a first side portion defining a first side of the body, a second side portion defining a second side of the body, a central portion disposed between the first side portion and the second side portion, a first side recess at a first central portion side, a second side recess at a second central portion side opposite the first central portion side, a first end cutout at a first end portion, and a second end cutout at a second end portion;

the first and second side portions extending from said central portion so as to define spaces therebetween on either side of said central portion;

a first axle extending from the first side portion to the second side portion through the first end cutout at the first end portion;

a first axle fastener fastening the first side portion and the second side portion so as to apply a first axle compression force between the first side portion and the second side portion while the central portion maintains a separation of the first side portion and the second side portion;

a second axle extending from the first side portion to the second side portion through the second end cutout at a second end portion;

a second axle fastener fastening the first side portion and the second side portion so as to apply a second axle fastener compression force between the first side portion and the second side portion while the central portion maintains the separation of the first side portion and the second side portion;

a first plurality of tools rotatably coupled to the first axle, disposed at least partially in the first end cutout at the first end portion, and corresponding to a first plurality of fasteners of an object such that the first plurality of tools is configured to operate only with the first plurality of fasteners;

a second plurality of tools rotatably coupled to the second axle, disposed at least partially in the second end cutout at the second end portion, and corresponding to a second plurality of fasteners of the object such that the second plurality of tools is configured to operate only with the second plurality of fasteners;

a first central portion side first tool surface accommodating at least one of the first plurality of tools in a retracted configuration;

a first central portion side second tool surface extending from the first central portion side first tool surface and spaced from the first central portion side first tool surface towards the second side portion, disposed parallel to the first central portion side first tool surface, and accommodating at least one of the first plurality of tools in a retracted configuration such that the first plurality of tools in the retracted configuration is in a substantially parallel alignment;

a first central portion side third tool surface extending from the first central portion side second tool surface and spaced from the first central portion side first tool surface and the first central portion side second tool surface towards the second side portion and parallel to the first central portion side first tool surface and the first central portion side second tool surface;

a second central portion side first tool surface accommodating at least one of the second plurality of tools in a retracted configuration; and a second central portion side second tool surface spaced from the second central portion side first tool surface, disposed parallel to the second central portion side first tool surface, and accommodating at least one of the second plurality of tools in a retracted configuration such that the second plurality of tools in the retracted configuration is in a substantially parallel alignment.

* * * * *